US009403051B2

(12) United States Patent
Cutler

(10) Patent No.: US 9,403,051 B2
(45) Date of Patent: Aug. 2, 2016

(54) EXERCISE MACHINE

(71) Applicant: ICON Health & Fitness, Inc., Logan, UT (US)

(72) Inventor: Gordon Cutler, Providence, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 120 days.

(21) Appl. No.: 14/575,799

(22) Filed: Dec. 18, 2014

(65) Prior Publication Data

US 2015/0182783 A1 Jul. 2, 2015

Related U.S. Application Data

(60) Provisional application No. 61/922,701, filed on Dec. 31, 2013.

(51) Int. Cl.

| | |
|---|---|
| ***A63B 22/02*** | (2006.01) |
| ***A63B 71/06*** | (2006.01) |
| *A63B 22/00* | (2006.01) |
| *A63B 22/06* | (2006.01) |

(52) U.S. Cl.

CPC ..... *A63B 22/02* (2013.01); *A63B 71/0622* (2013.01); *A63B 22/0048* (2013.01); *A63B 22/0076* (2013.01); *A63B 22/0605* (2013.01); *A63B 22/0664* (2013.01); *A63B 2071/0658* (2013.01); *A63B 2225/682* (2013.01); *A63B 2225/685* (2013.01); *A63B 2225/687* (2013.01)

(58) Field of Classification Search

USPC ..... 482/1–148

See application file for complete search history.

(56) References Cited

U.S. PATENT DOCUMENTS

| | | | | |
|---|---|---|---|---|
| 5,085,427 | A | 2/1992 | Finn | |
| 5,797,578 | A * | 8/1998 | Graffeo | A47B 23/043 248/453 |
| 5,813,947 | A | 9/1998 | Densmore | |
| 5,940,502 | A * | 8/1999 | Hirai | B60R 11/0241 379/446 |
| 6,215,870 | B1 * | 4/2001 | Hirai | B60R 11/0241 379/446 |
| 6,944,294 | B2 * | 9/2005 | Tsay | B60R 11/0241 379/446 |
| 7,959,124 | B2 | 6/2011 | Phifer et al. | |
| 8,851,565 | B2 * | 10/2014 | Hontz | B60N 3/004 297/188.04 |
| 2008/0057889 | A1 * | 3/2008 | Jan | H04B 1/034 455/185.1 |
| 2011/0073743 | A1 | 3/2011 | Shamie | |
| 2013/0050973 | A1 | 2/2013 | Rohrbach | |
| 2013/0116095 | A1 | 5/2013 | Hsieh | |

* cited by examiner

*Primary Examiner* — Stephen Crow

(74) *Attorney, Agent, or Firm* — Holland & Hart LLP

(57) ABSTRACT

An exercise machine includes a frame and a console connected to the frame. The console has first member in a surface of the console and a second member in an adjustable portion of the console. Also, the machine has an assembly movably connected to the second member to translate the second member toward the first member with a sufficient force to hold an object in compression between the first member and the second member.

19 Claims, 10 Drawing Sheets

EXERCISE MACHINE

RELATED APPLICATIONS

This application claims priority to provisional Patent Application No. 61/922,701 titled "Aerobic Exercise Machine" filed Dec. 31, 2013. This application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, cycling, among others. In contrast, anaerobic exercise typically involves high intensity exercises over a short duration of time. Popular forms of anaerobic exercise include strength training and short distance running Many choose to perform aerobic exercises indoors, such as in a gym or their home. Often, a user will use an aerobic exercise machine to have an aerobic workout indoors. One such type of exercise machine for performing an aerobic workout is a treadmill, which is a machine that has a running deck attached to a support frame. The running deck can support the weight a person using the machine. The running deck incorporates a conveyor belt that is driven by a motor. A user can run or walk in place with the conveyor belt by running or walking at the conveyor belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical machines, rowing machines, stepper machines, and stationary bikes to name a few.

One type of treadmill is disclosed in U.S. Patent Publication No. 2013/0116095 issued to Paul Hsieh, et al. In this reference, a tread utility assembly includes a utility member frontwardly and movably extended from a control unit to form a utility console which has a predetermined angle of inclination with respect to the control unit. A user is allowed to simultaneously operate the control unit and run on the tread assembly, and accomplish a predetermined task on the utility console in a convenient and safe manner. Another type of treadmill is described in U.S. Pat. No. 5,085,427 issued to Bruce Finn. Both of these references are herein incorporated by reference for all that they disclose.

SUMMARY

In one aspect of the invention, an exercise machine includes a frame.

In one aspect of the invention, the exercise machine may further include a console connected to the frame of the machine.

In one aspect of the invention, the exercise machine may further include a first member in a surface of the console and a second member in an adjustable portion of the console.

In one aspect of the invention, the exercise machine may further include an assembly movably connected to the second member to translate the second member toward the first member along a linear track with a sufficient force to hold an object in compression between the first member and the second member.

In one aspect of the invention, the assembly is a slider assembly having a guide shaped to direct a section of the adjustable portion under a surface of the console.

In one aspect of the invention, the assembly has a spring with a first end attached to a structural member that is stationary with respect to the surface and a second end attached to the adjustable portion.

In one aspect of the invention, the first member and the second member are walls of a recessed area collectively formed by the surface of the adjustable portion.

In one aspect of the invention, at least one of the first member or the second member form an angle between 90 and 135 degrees with the surface.

In one aspect of the invention, the exercise machine further includes the assembly having a spring movably connected to the second member to translate the second member towards the first member.

In one aspect of the invention, the assembly has a threaded member arranged to guide the second member towards the first member.

In one aspect of the invention, the console further comprises an electronic panel instrumented to control at least one operation of the exercise machine.

In one aspect of the invention, the console further comprises a tilt control to control a tilt angle of the console with respect to the frame.

In one aspect of the invention, the assembly is sized to position the second member a distance from the first member sufficient to hold an electronic tablet.

In one aspect of the invention, the assembly is sized to position the second member a distance from the first member sufficient to hold a phone.

In one aspect of the invention, the assembly comprises a release mechanism movably connected to the second member to move the second member away from the first member to release the object.

In one aspect of the invention, the release mechanism comprises a lever.

In one aspect of the invention, an exercise machine has a frame.

In one aspect of the invention, the exercise machine further includes a console connected to the frame of the machine where the console further comprises an electronic panel instrumented to control at least one operation of the exercise machine.

In one aspect of the invention, the exercise machine may further include a first member in a surface of the console and a second member in an adjustable portion of the console where the first member and second member are walls of a recessed area collectively formed by the surface and the adjustable portion.

In one aspect of the invention, the exercise machine may further include an assembly movably connected to the second member to translate the second member toward the first member along a linear track with a sufficient force to hold an object in compression between the first member and the second member.

In one aspect of the invention, the assembly comprises a guide shaped to direct a section of the adjustable portion under the surface.

In one aspect of the invention, the exercise machine may further include a release mechanism positioned to slide the second member away from the first member to release the object.

In one aspect of the invention, the release mechanism has a lever.

In one aspect of the invention, at least one of the first member or second member forms an angle greater than 90 degrees with the surface.

In one aspect of the invention, the assembly comprises a tension spring arranged to pull the second member towards the first member.

In one aspect of the invention, the assembly is sized to position the second member a distance from the first member sufficient to hold an electronic tablet or a phone.

In one aspect of the invention, the exercise machine may further include a console connected to a frame of the machine where the console further comprises an electronic panel instrumented to control at least one operation of the exercise machine.

In one aspect of the invention, the exercise machine may further include a first member in a surface of the console and a second member in an adjustable portion of the console where the first member and second member are walls of a recessed area collectively formed by the surface and the adjustable portion.

In one aspect of the invention, the exercise machine may further include at least one of the first member or second member forms an angle greater than 90 degrees with the surface.

In one aspect of the invention, the exercise machine may further include an assembly movably connected to the second member to translate the second member toward the first member along a linear track with a sufficient force to hold an object in compression between the first member and the second member.

In one aspect of the invention, the assembly comprises a tension spring arranged to pull the second member towards the first member while directing a section of the adjustable portion under the surface.

In one aspect of the invention, the assembly comprises a release mechanism positioned to slide the second member away from the first member to release the object in response to an activation of a trigger.

Any of the aspects of the invention detailed above may be combined with any other aspect of the invention detailed herein.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof

Throughout the drawings, identical reference numbers designate similar, but not necessarily identical, elements.

DETAILED DESCRIPTION

The exercise machine may provide the user with a console that is capable of supporting an object that is independent of the exercise machine and that the user desires to use while exercising. In addition to the console including the control, the console can also include an adjustable holder that can accommodate such independent objects of varying sizes and dimensions. The console is attached to the machine's frame directly or indirectly through another component of the exercise machine. The console may include a first member in a surface of the console, and a second member may be incorporated into an adjustable portion of the console. The surface and the adjustable portions of the console are arranged such that adjustable portion can move with respect to the console's surface. For example, the adjustable portion may be arranged to slide adjacent to the console's surface and thereby extend the console's surface for holding the desired object. An assembly can be used to automatically retract the adjustable portion in the absence of a force that holds the adjustable portion in an extended position. As the assembly retracts the adjustable portion, the first member and the second member come closer together. As a result, first member and the second member can grip the desired object through compression.

Such a holder may be used to hold any appropriate desired object. For example, the holder can be used to secure an electronic tablet or phone. In such an example, the user can use such electronic devices secured to the console for entertainment purposes while exercising. In other examples, water bottles, books, audio devices, other electronic devices, images, other devices, or combinations thereof can be secured with the first and second member of the console.

Figure 1:
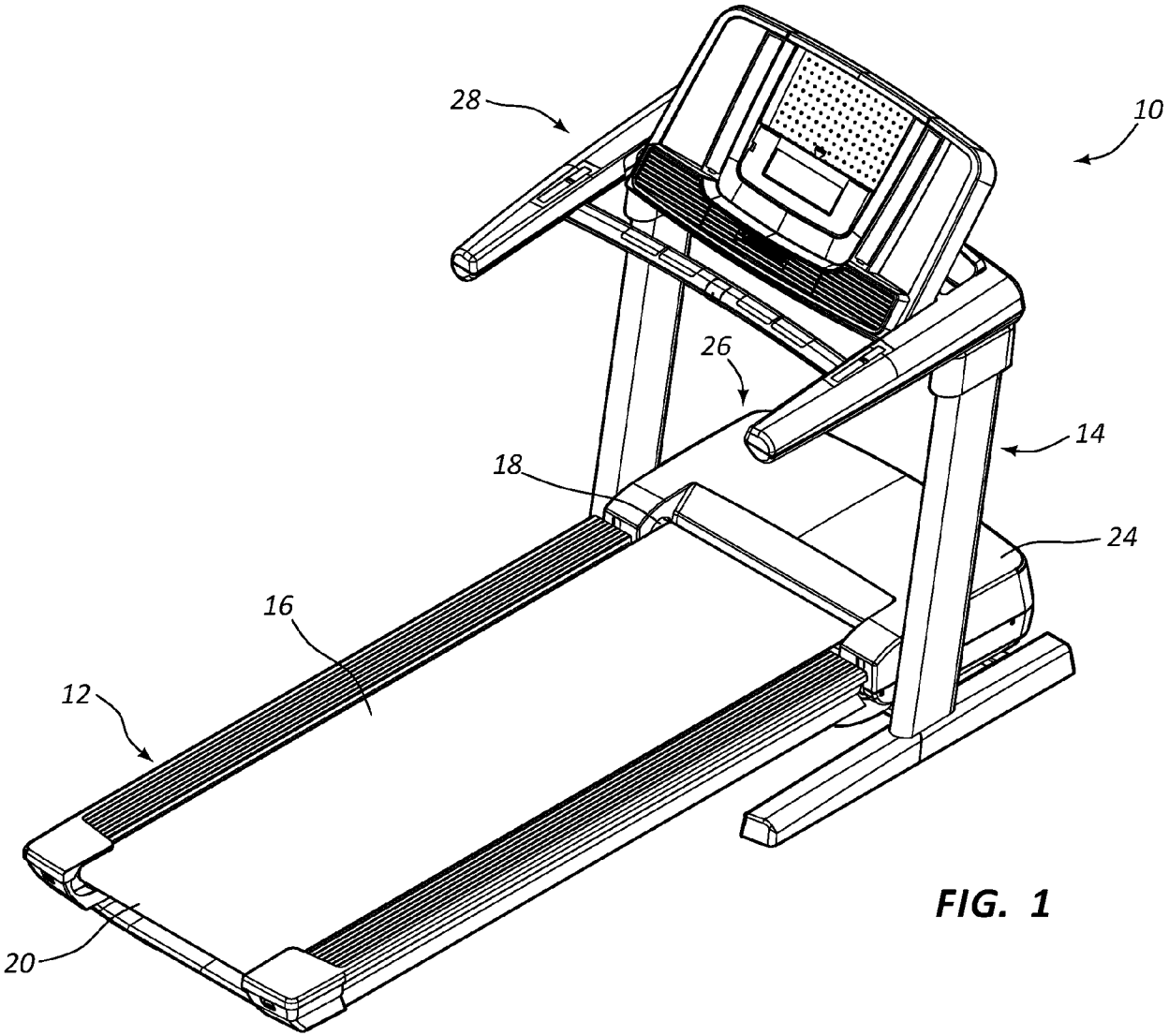
FIG. 1 illustrates a perspective view of an example of an exercise machine in accordance with the present disclosure.
Figure 2:
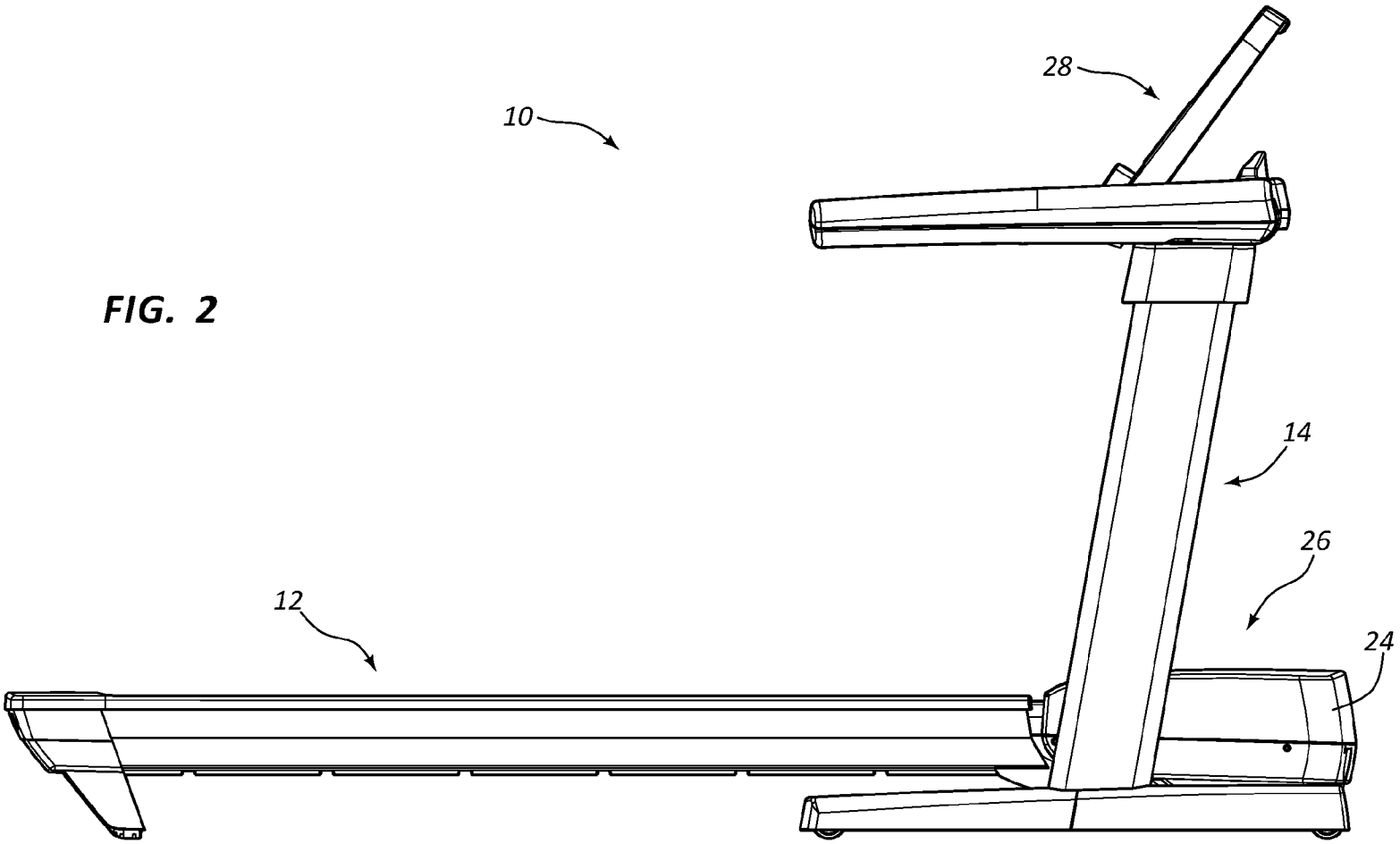
FIG. 2 illustrates a right side view of the exercise machine of FIG. 1.

Particularly, with reference to the figures, FIGS. 1-2 depict a treadmill 10. The treadmill 10 includes a running deck 12 that can support the weight of a user and that is attached to a supporting frame 14. The running deck 12 incorporates a conveyor belt 16 that extends from a first pulley 18 to a second pulley (not shown) at location 20. The underside of the conveyor belt's mid-section is supported by a low friction surface that allows the conveyor belt's underside to move without creating significant drag. The conveyor belt 16 is moved by a motor (not shown) that is connected to the first pulley 18 and is disposed within a housing 24 formed in a front portion 26 of the running deck 12. As the conveyor belt 16 moves, a user positioned on the conveyor belt 16 can walk or run in place by keeping up with the conveyor belt's speed.

A console 28 is also supported by the supporting frame 14. In the example of FIG. 1, a support member 30 positions a set of hand holds 32 near the console 28 such that a user can support himself or herself during exercise. The support member 30 is attached to a top end 34 of the supporting frame 14. The console 28 is supported by the first arm 36 and the second arm 38 of the support member 30 on which the hand holds 32 are formed. Further, a grip bar 40 extends from the first arm 36 to the second arm 38.

The console 28 allows the user to perform a predetermined task while simultaneously operating an exercise mechanism of the treadmill 10 such as operating the running deck 12.

Such predetermined tasks may be tasks that can be executed by a control module 42 incorporated into the console 28. The control module 42 may include controls to adjust the speed of the conveyor belt 16, adjust a volume of a speaker integrated into the treadmill 10, adjust a tilt angle of the running deck 12, select an exercise setting, control a timer, change a view on the control module's display 44, monitor the user's health parameters, perform other tasks, or combinations thereof. Buttons, levers, touch screens, or other mechanisms may be incorporated into the control panel and may be used by the user to control at least some of the functions mentioned above.

Figure 3:
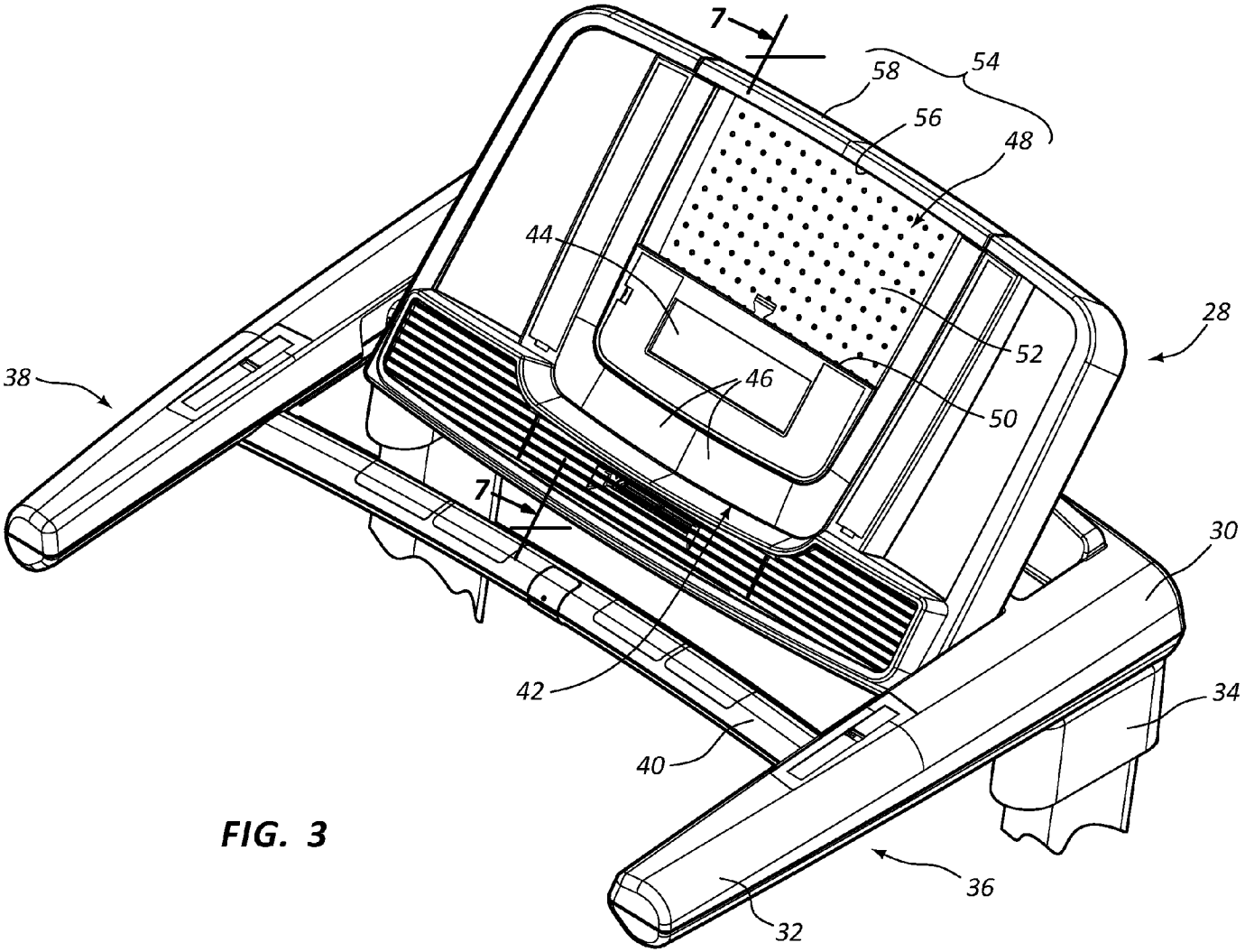
FIG. 3 illustrates a front perspective view of an example of a console in accordance with the present disclosure.
Figure 4:
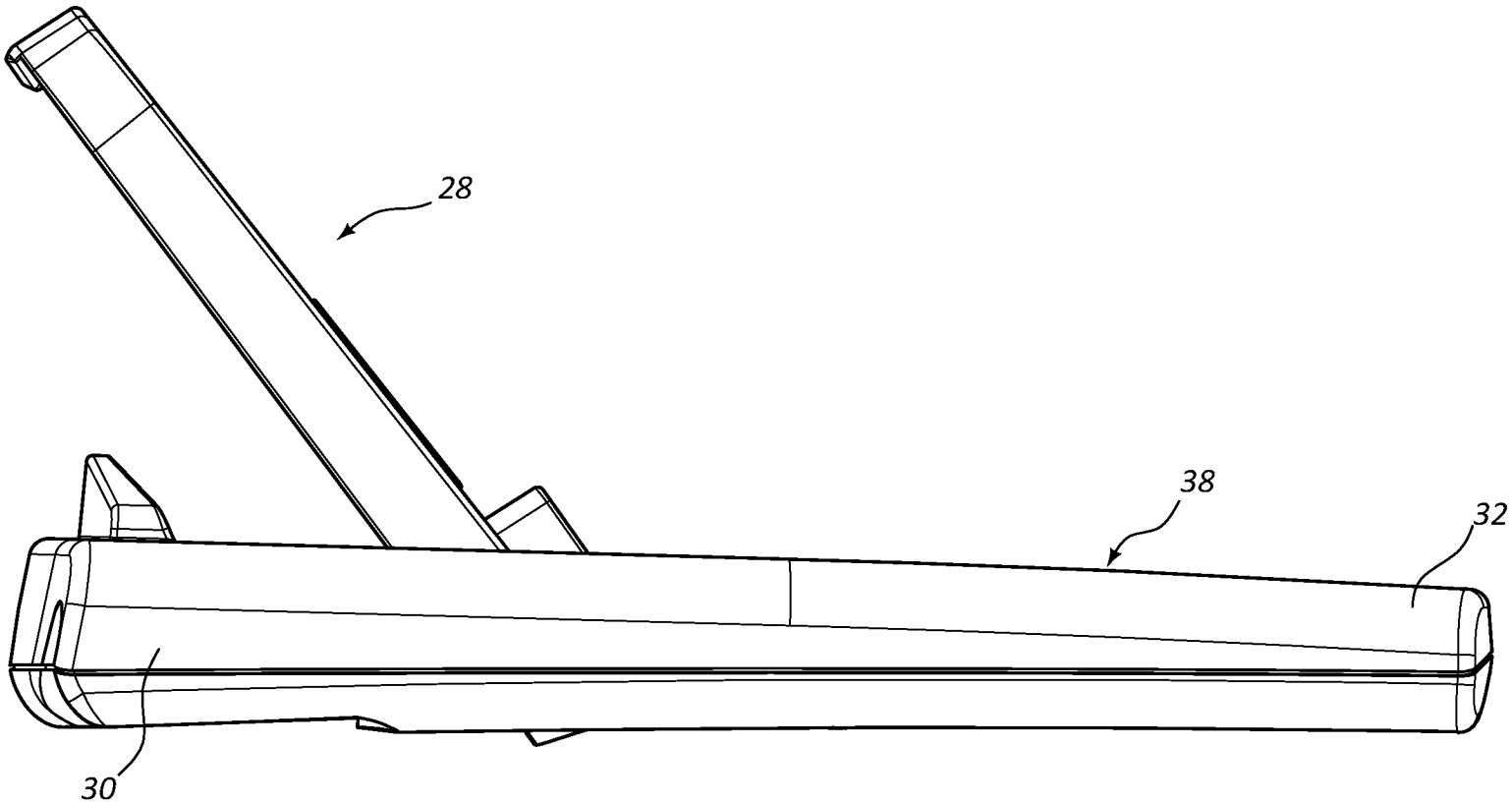
FIG. 4 illustrates a left side view of the console of FIG. 3.

Referring to FIGS. 3 and 4, the console 28 includes the control module 42, which incorporates the display 44 and multiple buttons 46 that can be used to control the functions mentioned above. Information relating to these functions may be presented to the user through the display 44. For example, a calorie count, a timer, a distance, a selected program, another type of information, or combinations thereof may be presented to the user through the display 44.

In some embodiments, the user may desire to have entertainment while exercising. Some entertainment may be available to the user through the display 44. However, the console 28 includes a holder 48 that can be used to secure objects (i.e. electronic tablets or phones) to the treadmill 10 that the user can operate while exercising. Thus, the user can take advantage of entertainment available through these secured objects without merely relying on what is available just through the display 44.

The holder 48 includes a first member 50 incorporated into a surface 52 of the console 28. The surface 52 may be located in any appropriate location on the console 28. In the example of FIG. 3, the surface 52 and the first member 50 are located within a central region 54 of the console 28 above the display 44. A second member 56 is located on an opposite side of the surface 52 and may be used to further support an object placed within the holder 48. The second member 56 is attached to an adjustable portion 58 of the console 28 and can slide away from the first member 50 to accommodate objects that are larger than the area of the surface 52. For example, if the object has a length that is greater than the distance between the first member 50 and the second member 56, the adjustable portion 58 may be extended to increase the distance and thereby exceed the height of the object desired to be secured to the console. In response to sizing the distance between the first member 50 and the second member 56, the user may insert the desired object between the first member 50 and the second member 56. After which, the user may allow the adjustable portion 58 to retract such that the first member 50 and the second member 56 come into contact with the object. The first member 50 and the second member 56 may compress the object to allow the first member 50 and the second member 56 to firmly grip the object. In some examples, the first member 50 is stationary with respect to the rest of the console 28. However, in alternative examples, both the first member 50 and the second member 56 are arranged to move with respect to the rest of the console 28.

Figure 5:
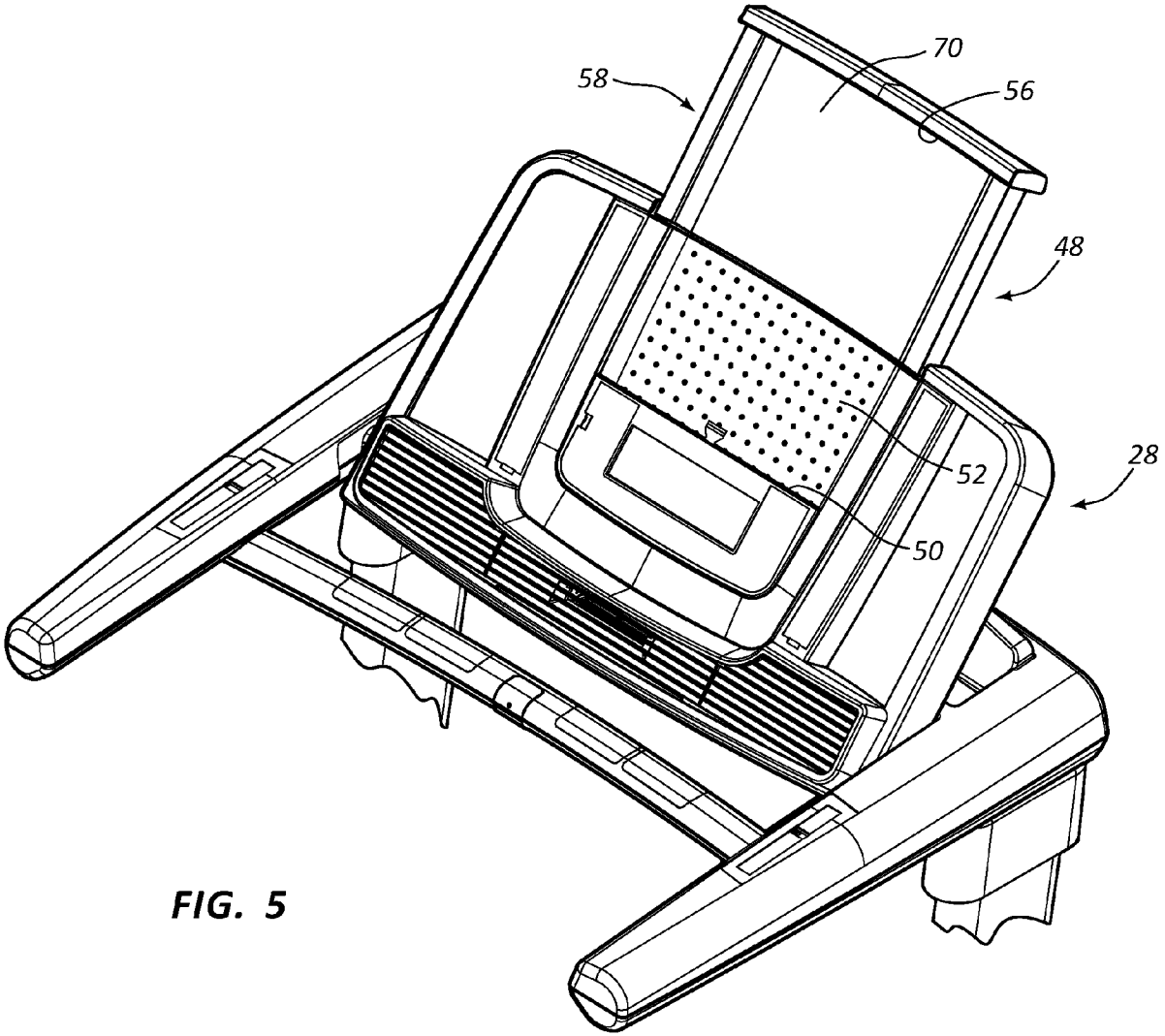
FIG. 5 illustrates a front perspective view of an example of a console in accordance with the present disclosure.

FIG. 5 illustrates a front perspective view of a console 28 with the adjustable portion 58 extended. The adjustable portion 58 may slide along a track or guide under the surface 52 of the console 28. Further, the adjustable portion 58 may be spring loaded such that a spring force is continuously urging the second member 56 towards the first member 50. As such, an appropriate object placed between the first member 50 and the second member 56 where the second member 56 is released from a user's hand grip will be subjected to a compressive force that firmly holds the object in place. Further, the combination of the adjustable portion's sliding feature and spring loaded mechanism allows the holder 48 to accommodate a wide variety of objects of different sizes and dimensions.

Figure 6:
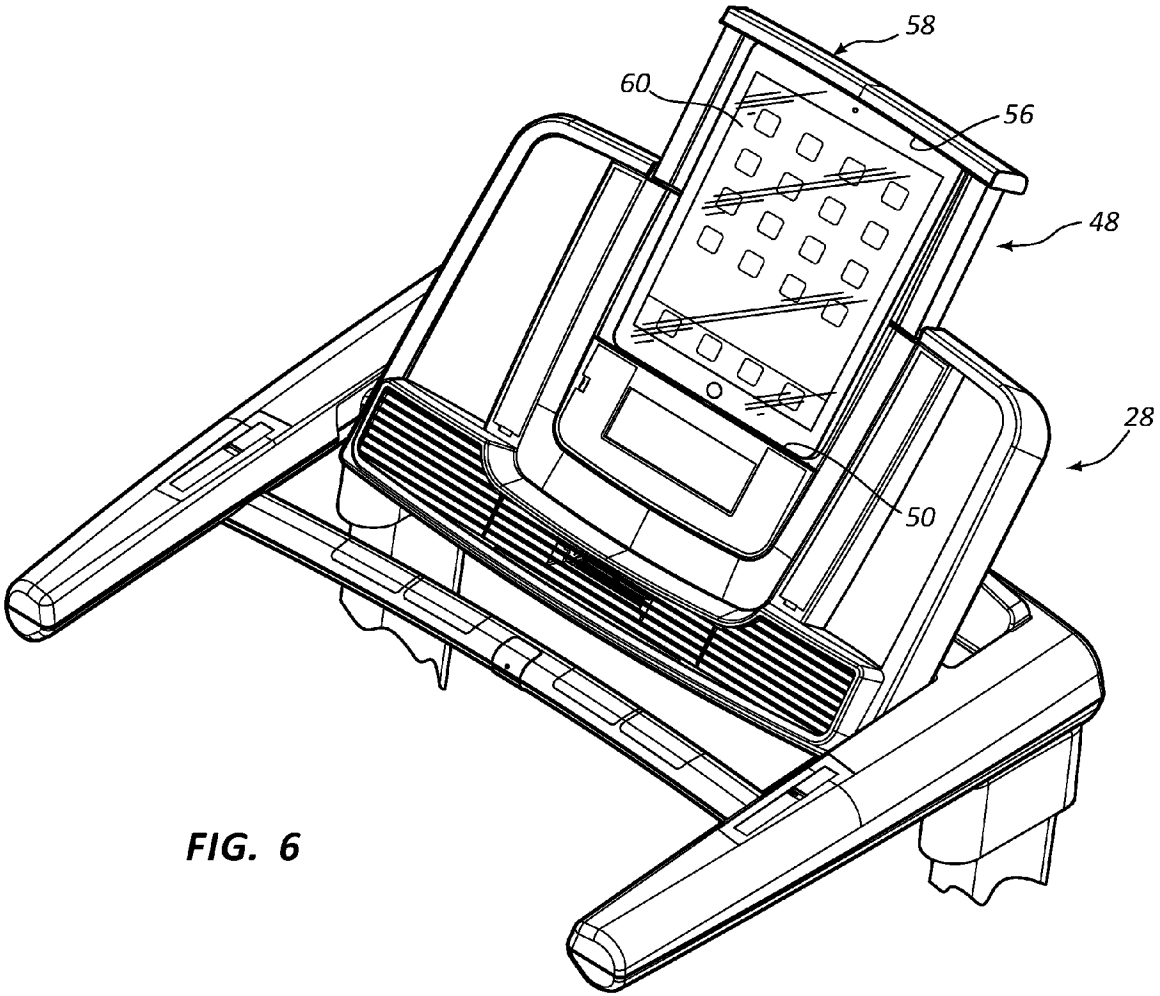
FIG. 6 illustrates a front perspective view of the console of FIG. 3.

FIG. 6 illustrates a front perspective view of the console of FIG. 3 with an object 60 secured to the console 28. In the example of FIG. 6, the object 60 is an electronic tablet that is capable of displaying videos, providing audio entertainment, providing gaming options, or combinations thereof. In some examples, the electronic tablet may include applications that assist the user while exercising.

When the second member 56 is pulled towards the first member 50 due to the spring bias, the second member 56 and the first member 50 impose a compressive force on the object 60 sufficient to firmly hold the object 60 in place. However, the spring bias creates a compressive load between the first member 50 and the second member 56 that is not strong enough to deform or damage an object such as an electronic table or phone.

Figure 7:
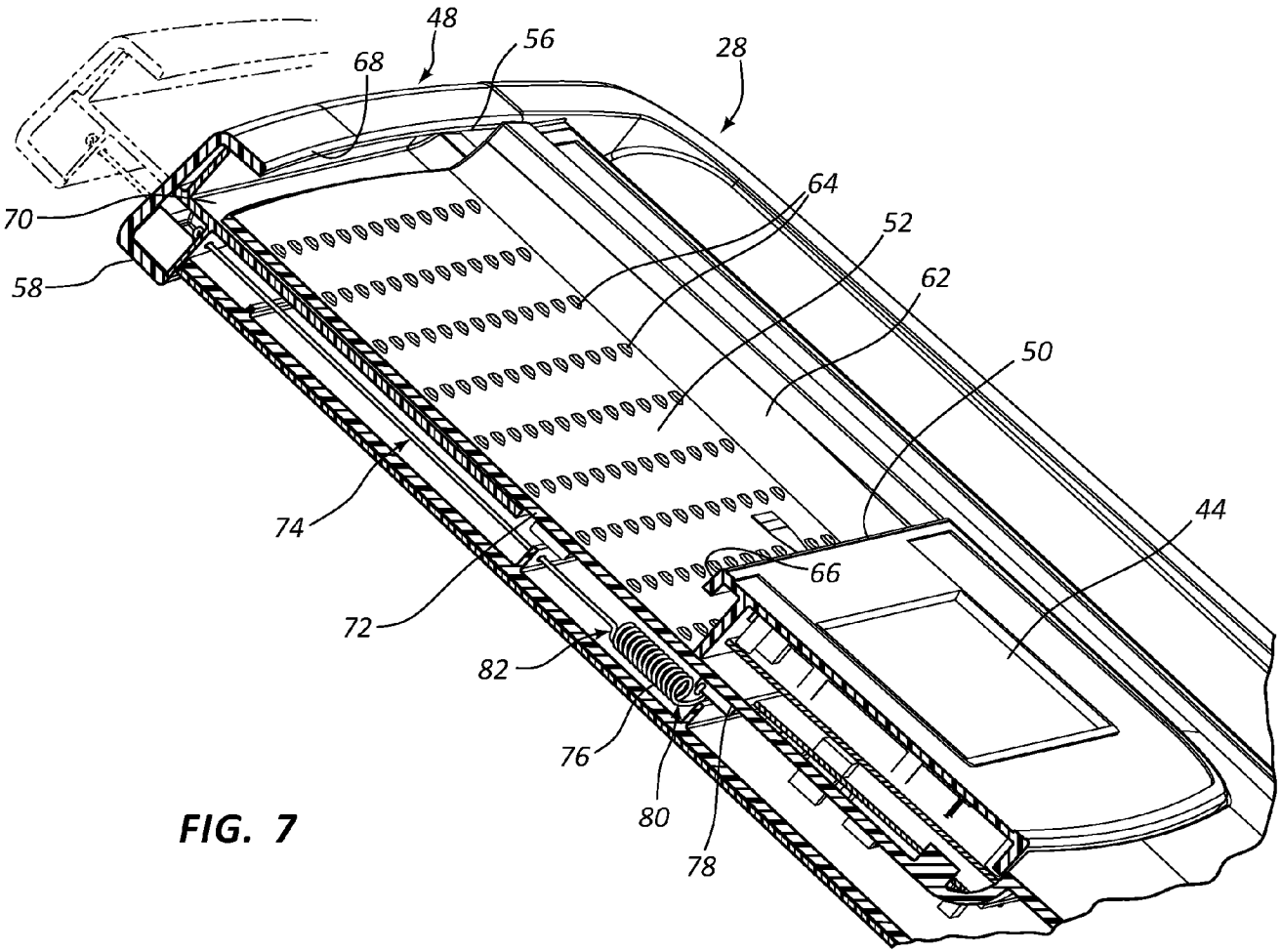
FIG. 7 illustrates a cross-sectional view of the console of FIG. 3 taken along cross section indicators (7-7).

FIG. 7 illustrates a cross-sectional view of the console of FIG. 3 taken along cross section indicators (7-7). The console 28 includes a surface 52 that has a sufficient material and thickness to support the weight of the object. Here, the surface 52 is recessed into the console 28. As a result, the first member 50 and the second member 56 are walls formed by the recess of the surface 52. The recess of the surface 52 also forms side walls 62 that can accommodate the size of the object. In some embodiments, the surface 52 includes nodules 64, a rough surface, or other features that can grip the object to prevent the object from sliding from side to side when a width of the object does not fill the width of the surface 52 from side wall to side wall.

In the example of FIG. 7, the first member 50 and the second member 56 are generally perpendicular to the surface 52. Further, the first member 50 may contain a first lip 66 and the second member 56 may contain a second lip 68 that may further assist to prevent the objects from moving within the holder.

The adjustable portion 58 includes a slidable surface 70 that supplements the surface 52 when the adjustable portion is extended. The underside 72 of the surface 52 or another appropriate feature within a cavity 74 under the surface 52 may guide the adjustable portion 58 as it is pulled out from under the surface 52. The adjustable portion 58 may be extended by a user's hand gripping the second member 56 and pulling in a direction away from the first member 50.

A spring 76 is located under the surface 52 and is connected to an structure 78 affixed to the first member 50 on a first end 80 and connected to the adjustable portion 58 on a second end 82. As the adjustable portion 58 is extended, the spring 76 is stretched, and a spring bias is generated that urges the adjustable portion to return to its resting position under the surface 52. The spring 76 may provide a force sufficient to firmly hold an object when the adjustable portion 58 is released from a user's hand grip. However, such a spring force may be insufficient to deform or otherwise damage the object.

Figure 8:
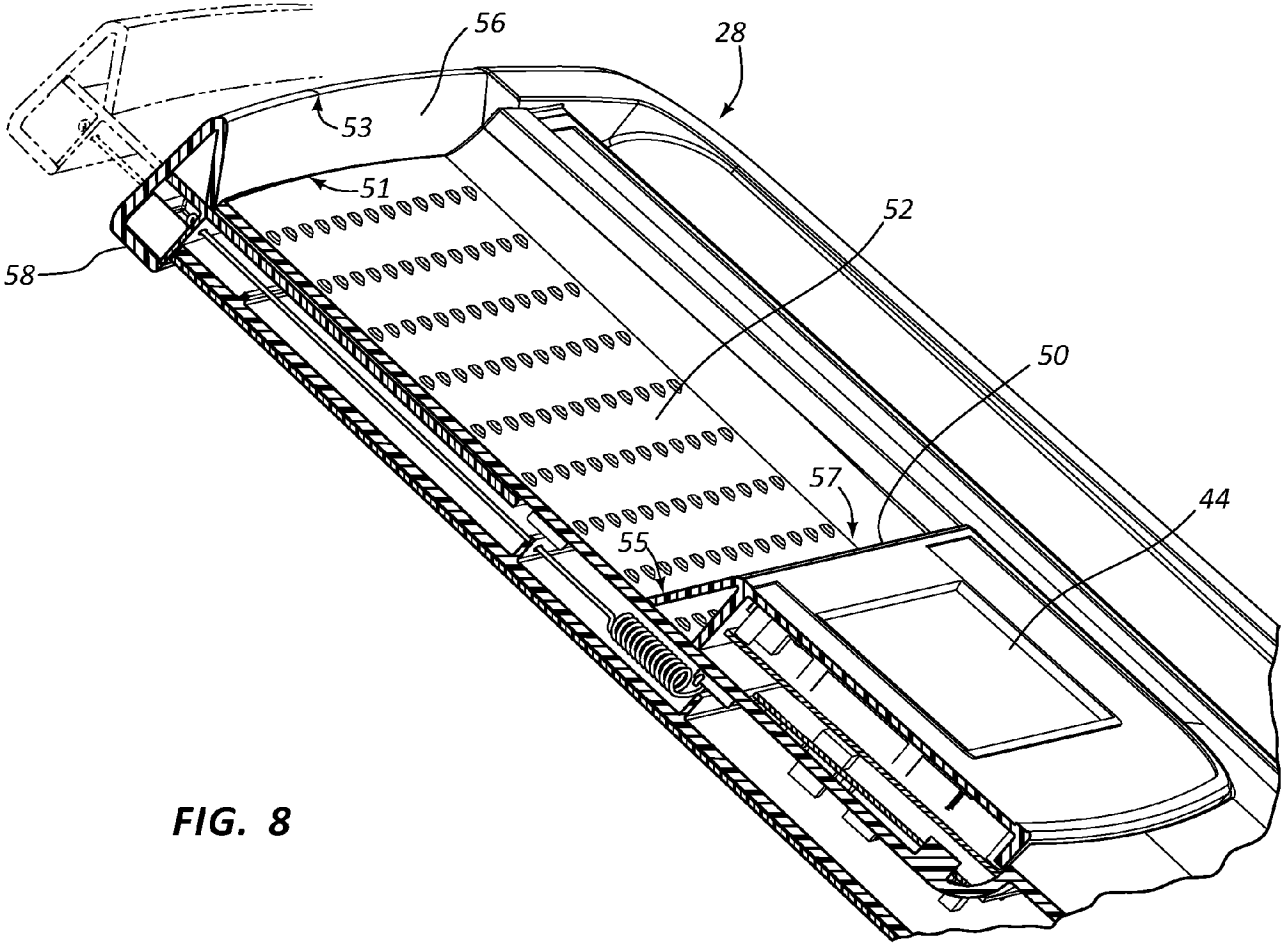
FIG. 8 illustrates a cross-sectional view of an example of a console in accordance with the present disclosure.

While this example has been described with reference to a spring bias force that is generated with a tension spring, any appropriate type of mechanism for generating a spring bias may be used in accordance with this disclosure. For example, the spring bias may be generated through the use of compression springs, multiple springs, wave springs, rubber, elastic material, gas springs, coil springs, torsion springs, flat springs, Belleville springs, other types of springs, or combinations thereof FIG. 8 illustrates a cross-sectional view of a console in accordance with the present disclosure. In this example, the first member 50 and the second member 56 are angled with respect to the surface 52. The angle formed between the surface 52 and the wall of the first member 50 and/or the second member 56 may be between 90 degrees and 135 degrees. The angled members may allow a user to insert an object into the holder 48 without having to pull the adjustable portion 58 out. For example, a user may press the desired object towards the surface 52. As the sides of the desired object make contact with the first member 50 and the second member 56, which are angled, the lateral load may be induced that causes the second member 56 and the adjustable portion 58 to slide in a direction away from the first member 50 as the object is inserted deeper into the holder 48. Thus, a user may wedge the desired object into the holder 48 in a single motion. In such an example, the angle of the first member 50 and the second member 56 is high enough to translate a force that is substantially perpendicular to the surface into a force that is substantially aligned with the guide of the adjustable portion 58. Further, such an angle is also low enough to establish a grip strong enough to firmly hold the object in place. Additionally, in such an example, the first member 50 and the second member 56 generate a sufficient amount of friction with the object to overcome the bias spring force and thereby prevent the first member 50 and the second member 56 from slipping off of the object and releasing their hold on the object. In some examples, both the first member 50 and the second member 56 form angles greater than 90 degrees with respect to the surface 52. In other examples, just one of the first member 50 or the second member 56 form an angle greater than 90 degrees with respect to the surface 52. Additionally, a polymer, a surface treatment, a surface finish, or another friction increasing material may be formed on the surface 52 to increase the hold of the object inserted into the holder 48.

In examples where the first member 50 and the second member 56 are angled. The distance between a first base 55 of the first member 50 and a second base 51 of the second member 56 is shorter than a distance between a first rim 57 of the first member 50 and a second rim 53 of the second member 56. In some examples, when the adjustable portion 58 is in a resting, retracted position, the distance from the first rim 57 of the first member 50 to the second rim 53 of a second member 56 may be slightly greater than a standard height of a popular device such as an electronic tablet or phone. In the same example, the distance from first base 55 of the first member 50 to the second base 51 of the second member 56 may be shorter that the standard height of the popular device. As a result, the user may fit the popular device between the first rim 57 of the first member 50 and a second rim 53 of the second member 56 and then push inward. Before pushing inward, the popular device may be loosely held in place by the first member 50 and the second member 56. While pushing inward, the angles of the first member 50 and the second member 56 cause the adjustable portion 58 to extend so that the distance between the first base 55 of the first member 50 and the second base 51 of the second member 56 matches the height of the popular device. When the user discontinues pushing inward on the popular device, the compressive grip of the first member 50 and the second member 56 securely holds the popular device in place.

While this example has been described with reference to a surface 52 for holding the objects, in other embodiments, the surface is not recessed. In such examples, the first member 50 and the second member 56 may protrude out of the console to hold the objects. Further, while the above examples have been described with reference to a first member and a second member that are generally formed in a horizontal orientation, the first and second members may be positioned in any appropriate orientation. For example, the first and second members may be formed in generally vertical orientations or angular orientations that may grip the sides, top, bottom, corners, or other regions of the object.

Figure 9:
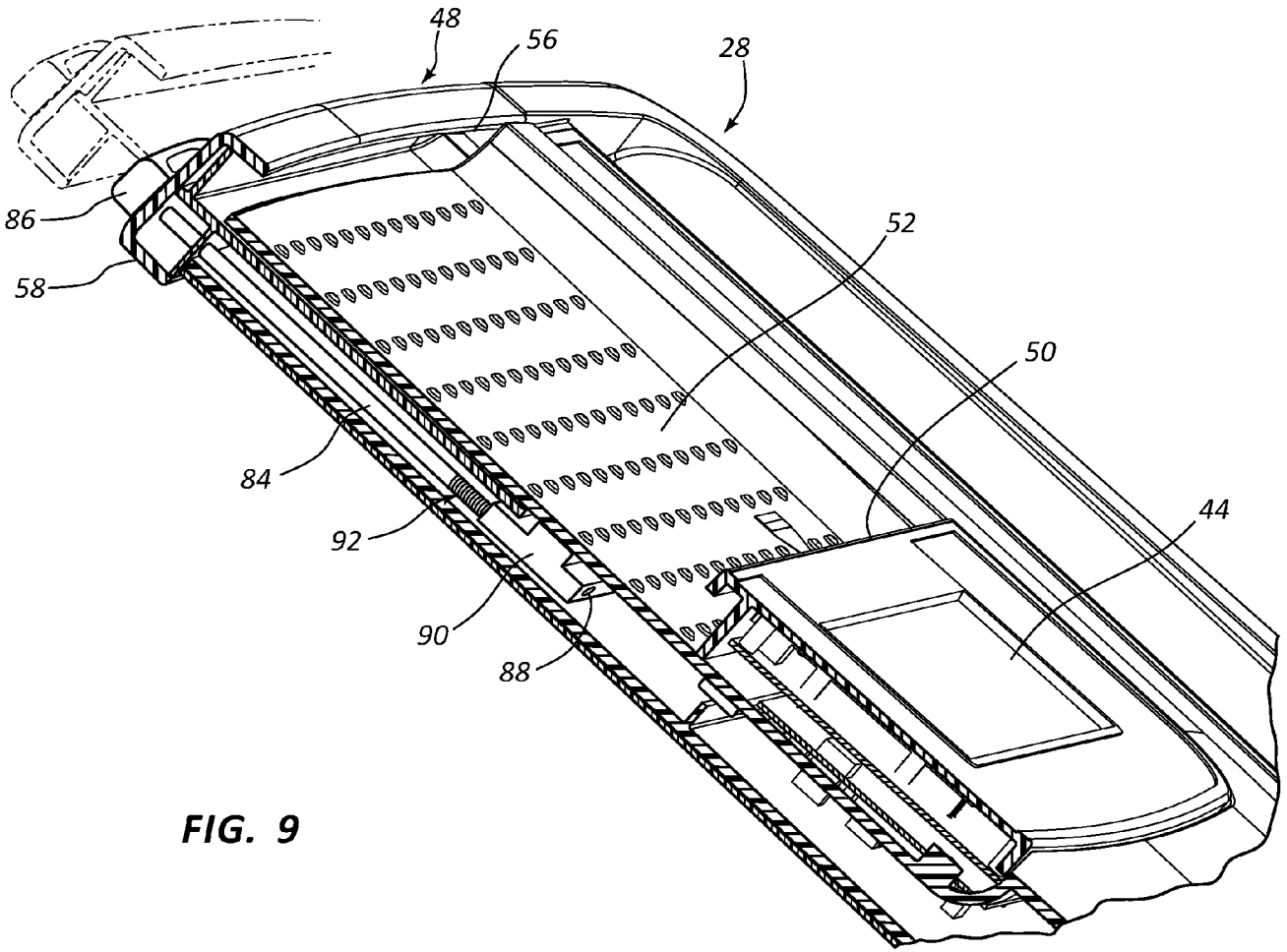
FIG. 9 illustrates a cross-sectional view of an example of a console in accordance with the present disclosure.

Additionally, while the examples above have been described with reference to specific geometries for the first and second members, any appropriate geometry may be used in accordance with this disclosure. For example, the first and second members may be perpendicular to the surface, angled with respect to the surface, rounded, angled, non-continuous, jagged, curved, bent, stepped, incorporating lips or other features, having other characteristics, or combinations thereof FIG. 9 illustrates a cross-sectional view of a console in accordance with the present disclosure. In this example, the adjustable portion 58 is extended or retracted with a threaded member 84 arranged to guide the second member 56 towards the first member 50. A handle 86 is positioned adjacent to the second member 56 and is connected to the threaded member 84. The threaded member 84 extends to the threaded bore 88 in a block 90 formed on the underside of the surface 52. The block 90 is affixed to a structural member such that the block is fixed with respect to the surface 52. A threaded portion 92 of the threaded member interacts with the threaded bore 88 and causes the threaded member 84 to translate along its length as the handle 86 is rotated about a rotational axis. As the threaded member 84 moves, the threaded member 84 moves the adjustable portion 58 in the same direction. Thus, by rotating the handle 86, the adjustable portion is also moved. Consequently, the user can rotate the handle 86 in a first direction to extend the adjustable portion 58 and insert the desired object. Likewise, the user can turn the handle 86 in a second direction to retract the adjustable portion 58 to cause the second member 56 to make a firm contact with the object or return to its retracted position.

In examples where the adjustable portion 58 is extended or retracted with a threaded member 84, the user can determine the appropriate amount of compressive force to apply to the object. For example, if the object appears to be prone to slip out of the holder 48, the user can increase the compressive force between the first member 50 and the second member 56 to hold the object more securely. Likewise, if the object appears to be prone to breaking under a compressive force, the user can apply the amount of compressive force that seems appropriate for such an object. Thus, examples with the threaded member 84 may allow the user to customize the compressive loads imposed on the object.

Figure 10:
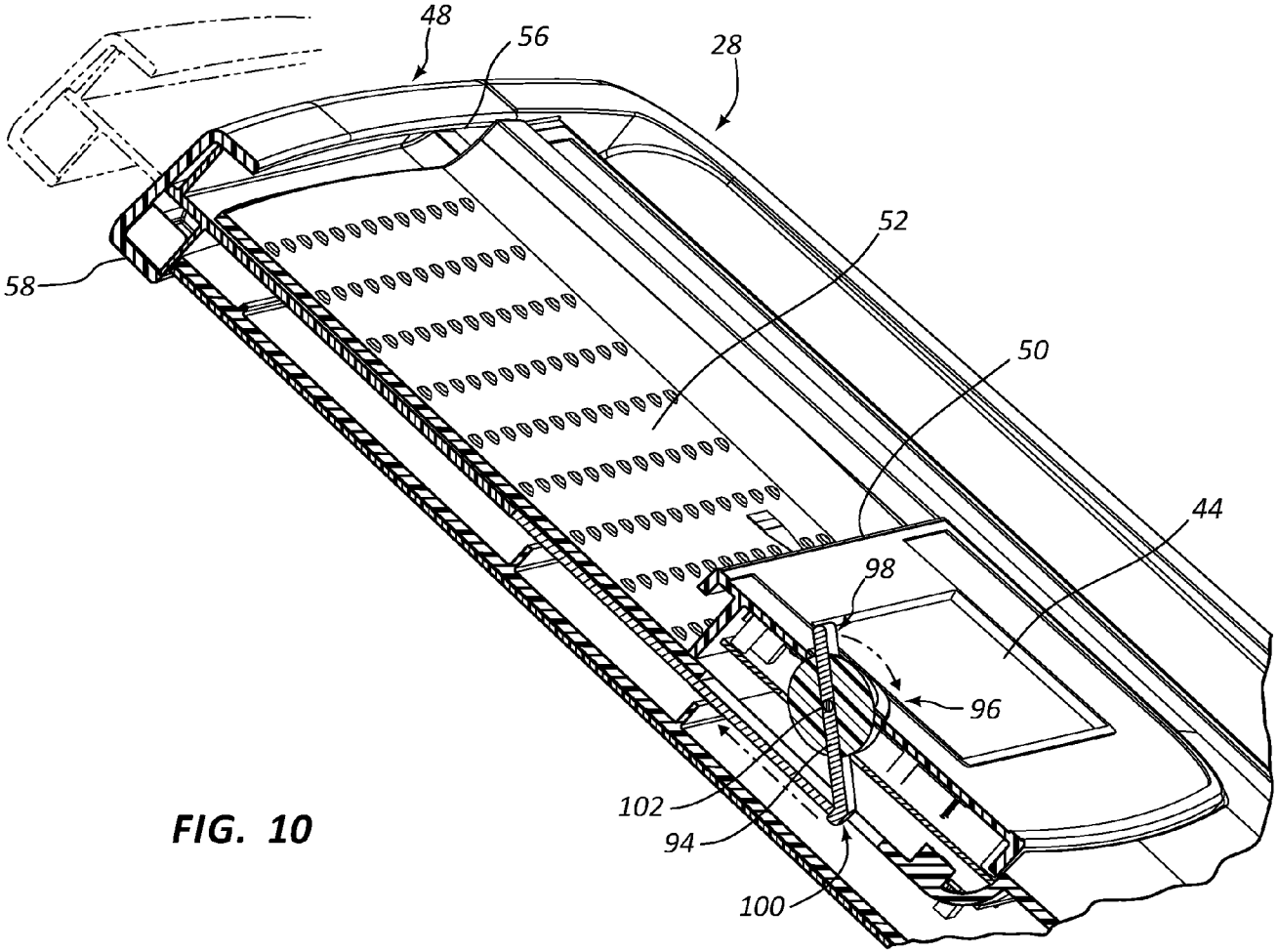
FIG. 10 illustrates a cross-sectional view of an example of a console in accordance with the present disclosure.

FIG. 10 illustrates a cross-sectional view of a console in accordance with the present disclosure. In this example, the position of the adjustable portion 58 is determined by an orientation of a lever 94 of a release mechanism 96 incorporated into the console 28. The release mechanism 96 includes the first portion 98 that is accessible to the user through the console 28, and a second portion 100 that is covered by the console 28. The second portion 100 is mechanically linked to the adjustable portion 58. A fulcrum 102 is positioned between the first portion 98 and the second portion 100 of the lever 94. When the first portion 98 is placed in a retracted position, the first portion 98 of the lever 94 is moved such that the second portion 100 is moved by the fulcrum 102 to pull the adjustable portion 58 into a retracted position as well. Likewise, when the first portion 98 of the lever 94 is placed in an extended position, the second portion 100 pushes the adjustable portion 58 so that the adjustable portion moves into an extended position.

In this example, the release mechanism 96 can be used to position the adjustable portion 58 in either an extended position or a retracted position. In other examples, such a release mechanism is capable of positioning the adjustable portion 58 in additional positions. In yet further examples, the release mechanism may be used to just move the adjustable portion 58 into an extended position to release the object.

While this example has been described with reference to a specific type of release mechanism, any appropriate type of release mechanism may be used in accordance with the present disclosure. For example, a button, a switch, or another type of trigger may be used to induce a temporary force that causes the adjustable portion 58 to move into an extended position. In yet other examples, a spring mechanism is used to release an object in the holder 48 by temporarily moving the adjustable portion.

While the above examples have been described with reference to specific mechanisms for positioning the adjustable portion 58, any appropriate type of mechanism for positioning the adjustable portion 58 may be used. For example, other types of mechanical mechanisms may be incorporated into the release mechanism. Further, electrical actuators, linear actuators, or other types of actuators may be used to change the position of the adjustable portion 58. In some examples, the user may control the position of the adjustable portion 58 and/or the compressive force between the first member 50 and the second member 56 through the control module 42.

The examples above have also been described with reference to the first member being formed on a surface of the console. However, in other examples, the first member is formed in the adjustable portion. Likewise, the examples above have been described with the adjustable portion being arranged to extended in an upward direction from the console. However, in other examples, the adjustable portion can extend to the side with respect to the console or downward with respect to the console. In yet other examples, the adjustable portion may slide over a portion of the console such that when the adjustable portion is in an extended position, a portion of the console is covered from the user's view.

Further, the components of the holder described above may be made of any appropriate type of material. For example, the holder's components may be made a plastic, another material, or combinations thereof. Further, the components of the holder may be thermoformed, stamped, extruded, molded, or otherwise formed.

While the embodiments have been described above with specific reference to treadmills, the principles described herein may be incorporated into any appropriate exercise machine. For example, the console, holder, and its associated components may be incorporated into elliptical machines, rowing machines, stepper machines, stationary bikes, other types of exercise machines, or combinations thereof

INDUSTRIAL APPLICABILITY

In general, the invention disclosed herein may provide a user the advantage of securing a device that is independent of the exercise machine in an easy and convenient way while operating an exercise mechanism of the machine. Such exercise mechanisms may include a treadmill running deck, pedals of a stationary bike or elliptical, or another exercise mechanism of a different type of exercise machine. The holder described herein allows for common objects such as phones or electronic tablets to the securely fixed to the exercise machine while the machine is operated by the user. Such devices may provide the user entertainment or information that may assist the user throughout his or her workout.

The holder described herein provides the advantage that the user can have entertainment devices positioned within a convenient arms reach and also place the speakers of such devices within an convenient distance to the user. Further, due to the vibrations caused by the exercising motion of the machine, the slope of the console, or other factors, the principles in the current disclosure described above prevent the object from falling off of the console. Further, a user may desire to operate an object such as an electronic tablet or phone while exercising by pressing a touch screen of the secured object. The holder described above prevents the user from inadvertently pushing the object off of the console or moving the console from its desired position while pressing the object's touch screen by providing a holder that firmly keeps the desired object in place.

Further, embodiments of the holder described herein include convenient mechanisms for extending and retracting the adjustable portion of the console and thereby making it convenient for the user during exercise while the user may have less agility to secure an object to the exercise machine without interrupting the workout. The spring loaded feature of the adjustable portion simplifies the placement of the object so that the user does not have to continuously make adjustments to secure the object.

Additionally, the first and second members are shape to reduce the user's effort when securing the objects to the console. For example, in those embodiments with angled members, the user's efforts are reduced by allowing the user to merely push the desired object in place without having to use one hand to slide out the adjusting portion of the console and to place the object with the other hand.

The release mechanism allows a user to free the secured object in a convenient manner by moving a lever or activating another trigger. Thus, when the user is exhausted after a workout or has less agility during a workout, the user can remove the object with minimal hassle.

What is claimed is:

1. An exercise machine, comprising:

a frame;

a console connected to the frame said console further comprises an electronic panel instrumented to control at least one operation of the exercise machine;

a first member in a surface of the console and a second member in an adjustable portion of the console; and an assembly movably connected to the second member to translate the second member toward the first member along a track with a sufficient force to secure an object in compression between the first member and the second member.

2. The exercise machine of claim 1, wherein the assembly is a slider assembly comprising a guide shaped to direct a section of the adjustable portion under the surface.

3. The exercise machine of claim 1, wherein the assembly comprises a spring with a first end attached to a structural member that is stationary with respect to the surface and a second end attached to the adjustable portion.

4. The exercise machine of claim 1, wherein the first member and the second member are walls of a recessed area collectively formed by the surface and the adjustable portion.

5. The exercise machine of claim 1, wherein at least one of the first member or the second member form an angle between 90 degrees and 135 degrees with the surface.

6. The exercise machine of claim 1, wherein the assembly comprises a spring movably connected to the second member to translate the second member towards the first member.

7. The exercise machine of claim 1, wherein the assembly comprises a threaded member positioned to guide the second member toward the first member.

8. The exercise machine of claim 1, wherein the console comprises a tilt control arranged to control a tilt angle of the console with respect to the frame.

9. The exercise machine of claim 1, wherein the assembly is sized to position the second member a distance from the first member sufficient to hold an electronic tablet.

10. The exercise machine of claim 1, wherein the assembly is sized to position the second member a distance from the first member sufficient to hold a phone.

11. The exercise machine of claim 1, wherein the assembly comprises a release mechanism movably connected to the second member to move the second member away from the first member to release the object.

12. The exercise machine of claim 11, wherein the release mechanism comprises a lever.

13. An exercise machine, comprising:

a frame;

a console connected to the frame where the console further comprises an electronic panel instrumented to control at least one operation of the exercise machine;

a first member in a surface of the console and a second member in an adjustable portion of the console where the first member and the second member are walls of a recessed area collectively formed by the surface and the adjustable portion; and an assembly movably connected to the second member to translate the second member toward the first member along a linear track with a sufficient force to hold an object in compression between the first member and the second member; and the assembly comprising a guide shaped to direct a section of the adjustable portion under the surface.

14. The exercise machine of claim 13, wherein a release mechanism is positioned to slide the second member away from the first member to release the object.

15. The exercise machine of claim 14, wherein the release mechanism comprises a lever.

16. The exercise machine of claim 13, wherein at least one of the first member or the second member forms an angle greater than 90 degrees with the surface.

17. The exercise machine of claim 13, wherein the assembly comprises a tension spring arranged to pull the second member towards the first member.

18. The exercise machine of claim 13, wherein the assembly is sized to position the second member a distance from the first member sufficient to hold an electronic tablet or a phone.

19. An exercise machine, comprising:

a frame;

a console connected to the frame where the console further comprises an electronic panel instrumented to control at least one operation of the exercise machine;

a first member in a surface of the console and a second member in an adjustable portion of the console where the first member and the second member are walls of a recessed area collectively formed by the surface and the adjustable portion;

at least one of the first member or second member forms an angle greater than 90 degrees with the surface;

an assembly movably connected to the second member to translate the second member toward the first member along a track with a sufficient force to hold an object in compression between the first member and the second member;

the assembly comprising a tension spring arranged to pull the second member towards the first member while directing a section of the adjustable portion under the surface; and the assembly further comprising a release mechanism positioned to slide the second member away from the first member to release the object in response to an activation of a trigger.

* * * * *